US011598570B2

(12) United States Patent
Kim et al.

(10) Patent No.: US 11,598,570 B2
(45) Date of Patent: Mar. 7, 2023

(54) REFRIGERATOR INCLUDING A HEATER

(71) Applicant: SAMSUNG ELECTRONICS CO., LTD., Suwon-si (KR)

(72) Inventors: Sung Il Kim, Yongin-si (KR); Myeong Ju Kim, Gwangju (KR); Jeong Man Nam, Gwangju (KR); Hyung Hee Moon, Gwangju (KR); Jin Oh Seok, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 218 days.

(21) Appl. No.: 16/643,774

(22) PCT Filed: Aug. 29, 2018

(86) PCT No.: PCT/KR2018/009993
§ 371 (c)(1),
(2) Date: Mar. 2, 2020

(87) PCT Pub. No.: WO2019/045450
PCT Pub. Date: Mar. 7, 2019

(65) Prior Publication Data

US 2021/0164719 A1 Jun. 3, 2021

(30) Foreign Application Priority Data

Aug. 31, 2017 (KR) ..... 10-2017-0111516

(51) Int. Cl.
*F25D 21/04* (2006.01)
*F25D 23/04* (2006.01)
(Continued)

(52) U.S. Cl.
CPC ..... *F25D 21/04* (2013.01); *F25D 23/028* (2013.01); *F25D 23/04* (2013.01); *H05B 3/18* (2013.01);
(Continued)

(58) Field of Classification Search
CPC ..... F25D 21/04; H05B 2203/013
See application file for complete search history.

(56) References Cited

U.S. PATENT DOCUMENTS 7,008,032 B2 * 3/2006 Chekal ..... F25D 23/02 49/316
7,603,869 B2 * 10/2009 Kim ..... F25D 23/02 62/338
(Continued)

FOREIGN PATENT DOCUMENTS

KR 20-1995-012219 Y1 5/1995
KR 10-0716286 5/2007
(Continued)

OTHER PUBLICATIONS

Korean Office Action for Korean Patent Application No. 10-2017-0111516 dated Sep. 29, 2021.
(Continued)

*Primary Examiner* — Ana M Vazquez
(74) *Attorney, Agent, or Firm* — Staas & Halsey LLP

(57) ABSTRACT

The present disclosure relates to a refrigerator with improved productivity and quality by using a planar heater. The refrigerator includes a main body having a storage compartment, a door rotatably coupled to the body to open and close the storage compartment, and a planar heater installed on the door to prevent dew condensation from being generated on the door, wherein the planar heater is formed in a film form to be attached to the door.

8 Claims, 11 Drawing Sheets

(51) Int. Cl.
*H05B 3/18* (2006.01)
*H05B 3/20* (2006.01)
*F25D 23/02* (2006.01)

(52) U.S. Cl.
CPC ..... *H05B 3/20* (2013.01); *F25D 2323/021* (2013.01)

(56) References Cited

U.S. PATENT DOCUMENTS

| | | | | |
|---|---|---|---|---|
| 8,677,773 | B2 * | 3/2014 | Lee | F25D 21/04 62/331 |
| 9,080,808 | B2 * | 7/2015 | Choi | F25D 23/025 |
| 9,725,614 | B2 * | 8/2017 | Liu | B22F 1/07 |
| 2016/0205726 | A1 * | 7/2016 | Spielmann | H05B 3/12 219/543 |

FOREIGN PATENT DOCUMENTS

| | | |
|---|---|---|
| KR | 10-2010-0037194 | 4/2010 |
| KR | 10-2010-0037194 A | 4/2010 |
| KR | 10-1582510 | 1/2016 |
| KR | 10-1582510 B1 | 1/2016 |
| KR | 10-2016-0107658 A | 9/2016 |
| KR | 10-1721108 | 3/2017 |
| KR | 10-1721108 B1 | 3/2017 |
| WO | WO 2016-140555 | 9/2016 |

OTHER PUBLICATIONS

Seo Chan-Dong "Faro commercializes first film heater to replace refrigerator heating wire" Jul. 26, 2017, 3 pages.

Korean Office Action dated Mar. 16, 2022 in Korean Patent Application No. 10-2017-0111516 (8 pages, 11 pages English Translation).

Korean Office Action dated Sep. 23, 2022 in Korean Patent Application No. 10-2017-0111516 (6 pages; 12 pages English translation).

* cited by examiner

REFRIGERATOR INCLUDING A HEATER

CROSS-REFERENCE TO RELATED APPLICATIONS

This application is a U.S. National Stage Application which claims the benefit under 35 U.S.C. § 371 of International Patent Application No. PCT/KR2018/009993 filed on Aug. 29, 2018, which claims foreign priority benefit under 35 U.S.C. § 119 of Korean Patent Application No. 10-2017-0111516 filed on Aug. 31, 2017 in the Korean Intellectual Property Office, the contents of both of which are incorporated herein by reference.

TECHNICAL FIELD

The present disclosure relates to a refrigerator, and more particularly, to a refrigerator having an improved structure to prevent dew condensation.

BACKGROUND ART

Generally, a refrigerator is a home appliance including a storage compartment for storing food and a cold air supply device for supplying cold air to the storage compartment in order to keep the food in a fresh state.

Refrigerators may be classified into several types depending on the type of storage compartment and door. A top mounted freezer (TMF) type refrigerator is a refrigerator of a type in which a freezing chamber is formed at an upper side thereof and a refrigerating chamber is formed at a lower side thereof by partitioning the storage compartment up and down using a horizontal partition wall, and a bottom mounted freezer (BMF) type refrigerator is a refrigerator of a type in which a refrigerating chamber is formed at an upper side and a freezing chamber is formed at a lower side thereof. A side by side (SMS) type refrigerator is a refrigerator of a type in which a freezing chamber is formed at one side thereof and a refrigerating chamber is formed at the other side thereof by partitioning the storage compartment left and right using a vertical partition wall, and a French door refrigerator (FDR) is a refrigerator of a type in which a refrigerating chamber is formed at an upper side thereof and a freezing chamber is formed at a lower side thereof by partitioning the storage compartment up and down using a horizontal partition wall, and at the same time the refrigerating chamber formed at the upper side is opened and closed by a pair of doors.

Because an inner temperature of a refrigerator is lower than a temperature around the refrigerator, dew forms on a portion where a temperature difference occurs due to opening of a refrigerator door.

In order to prevent such dew condensation, a temperature difference may be reduced by installing a heater at a portion where the temperature difference occurs. For example, a heater may be installed on an outer edge of a refrigerator door.

In a conventional refrigerator, a cord heater is installed on a door frame to prevent dew condensation from being generated on a door. Specifically, the cord heater is disposed between aluminum foil and the door frame and the aluminum foil is brought into close contact with the door frame, so that the cord heater may be installed on the door frame.

However, the cord heater has a circular cross-sectional shape, which may cause the aluminum foil to be lifted. When the aluminum foil is lifted, a foam liquid may permeate between the cord heater and the aluminum foil, which may significantly lower the heating efficiency and cause a deterioration in quality.

In addition, the cord heater installation process as described above requires a large number of workers and the work time increases, thereby lowering the productivity.

In addition, when the cord heater is installed on the door frame, the cross section of the cord heater is not flat, and thus the flowability of the foam liquid foamed inside the door frame may be lowered.

In addition, the cord heater has a relatively small contact area due to the non-flat cross section, which results in a relatively low heating efficiency.

DISCLOSURE

Technical Problem

The present disclosure is directed to providing a refrigerator including a heater having a flat cross section to improve the flowability of a foam liquid foamed inside a door frame.

The present disclosure is directed to providing a refrigerator including a heater having a flat cross section to increase a contact area, thereby improving the heating efficiency.

The present disclosure is directed to providing a refrigerator in which a foam liquid does not permeate between aluminum foil and a heater to prevent deterioration of quality.

The present disclosure is directed to providing a refrigerator with improved productivity by increasing the installation efficiency of a heater.

TECHNICAL SOLUTION

One aspect of the present disclosure provides a refrigerator including a main body having a storage compartment, a door rotatably coupled to the body to open and close the storage compartment, and a planar heater installed on the door to prevent dew condensation from being generated on the door, wherein the planar heater is formed in a film form to be attached to the door.

The refrigerator may further include a gasket installed in the door to seal a gap between the main body and the door and having a magnet provided therein, and the planar heater may be provided adjacent to an outer edge of the gasket.

The door may include a first door and a second door rotatably coupled to opposite sides of the main body to open and close the storage compartment.

The refrigerator may further include a rotation bar rotatably coupled to the first door or the second door to seal a gap between the first door and the second door, and the rotation bar may include a planar heater attached to an inner surface of the rotation bar.

The door may include a dispenser to provide water, the dispenser may include a dispenser casing coupled to the door, and the dispenser casing may include a planar heater attached to an inner surface of the dispenser casing.

The planar heater may include a base film, a silver nanoparticle ink printed on one surface of the base film, a protective film laminated on one surface of the base film to protect the silver nanoparticle ink, and a double-sided tape attached to the protective film.

The base film may include a polyethylene terephthalate (PET) material.

The protective may include an ethylene-vinyl acetate copolymer (EVA) material.

The silver nanoparticle ink may be formed in a curve to transfer heat to a wide region.

Another aspect of the present disclosure provides a refrigerator including a main body having a storage compartment, a door rotatably coupled to the body to open and close the storage compartment and including a first frame and a second frame forming a foam space therein, an insulator foamed in the foam space to insulate the outside of the door and the storage compartment, and a planar heater installed on the door to prevent dew condensation from being generated on the door, wherein the planar heater is formed in a film form to be attached to the first frame.

The first frame includes a first surface facing the storage compartment when the door is closed and a second surface that is a rear surface of the first surface, and the planar heater may be attached to the second surface.

Advantageous Effects

According to a refrigerator of the present disclosure, the flowability of a foam liquid foamed inside a door frame can be improved by using a planar heater to have a flat cross section.

According to a refrigerator of the present disclosure, a contact area can be increased and the heating efficiency can be improved by using a planar heater to have a flat cross section.

According to a refrigerator of the present disclosure, a foam liquid cannot permeate between aluminum foil and a heater by using a planar heater to have a flat cross section, thereby preventing deterioration of quality.

According to a refrigerator of the present disclosure, the productivity can be improved by increasing the installation efficiency of a heater.

MODE OF THE INVENTION

Figure 1:
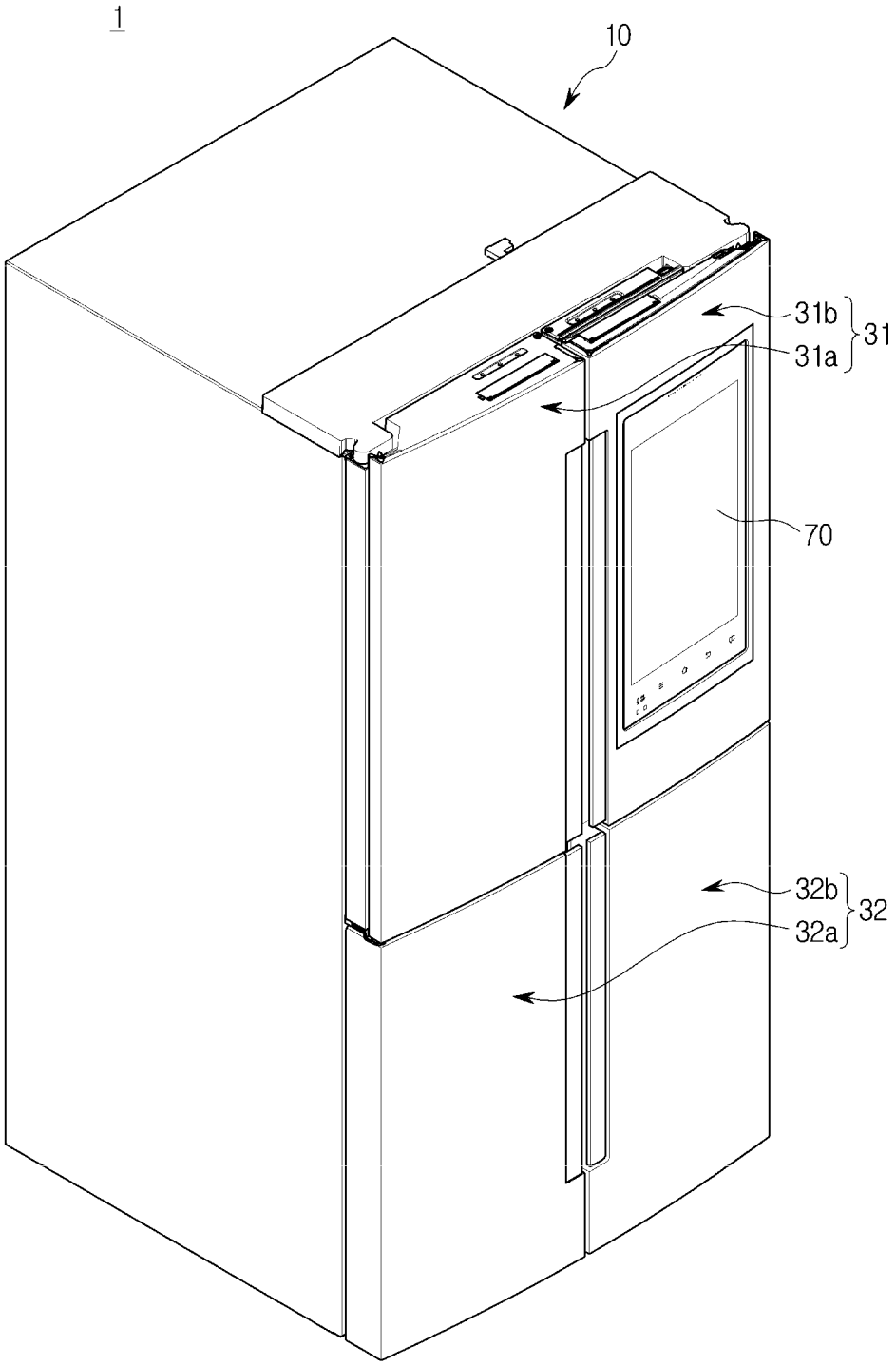
FIG. 1 is a perspective view of a refrigerator according to an embodiment of the present disclosure, showing a state in which doors are closed.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and has are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

Generally, a refrigerator is a home appliance including a storage compartment for storing food and a cold air supply device for supplying cold air to the storage compartment in order to keep the food in a fresh state. Refrigerators may be classified into several types depending on the type of storage compartment and door.

There is a top mounted freezer (TMF) type refrigerator in which a freezing chamber is formed at an upper side thereof and a refrigerating chamber is formed at a lower side thereof by partitioning the storage compartment up and down using a horizontal partition wall, and there is a bottom mounted freezer (BMF) type refrigerator in which a refrigerating chamber is formed at an upper side and a freezing chamber is formed at a lower side thereof.

In addition, there is a side by side (SMS) type refrigerator in which a freezing chamber is formed at one side thereof and a refrigerating chamber is formed at the other side thereof by partitioning the storage compartment left and right using a vertical partition wall, and there is a French door refrigerator (FDR) in which a refrigerating chamber is formed at an upper side thereof and a freezing chamber is formed at a lower side thereof by partitioning the storage compartment up and down using a horizontal partition wall, and at the same time the refrigerating chamber formed at the upper side is opened and closed by a pair of doors.

Figure 2:
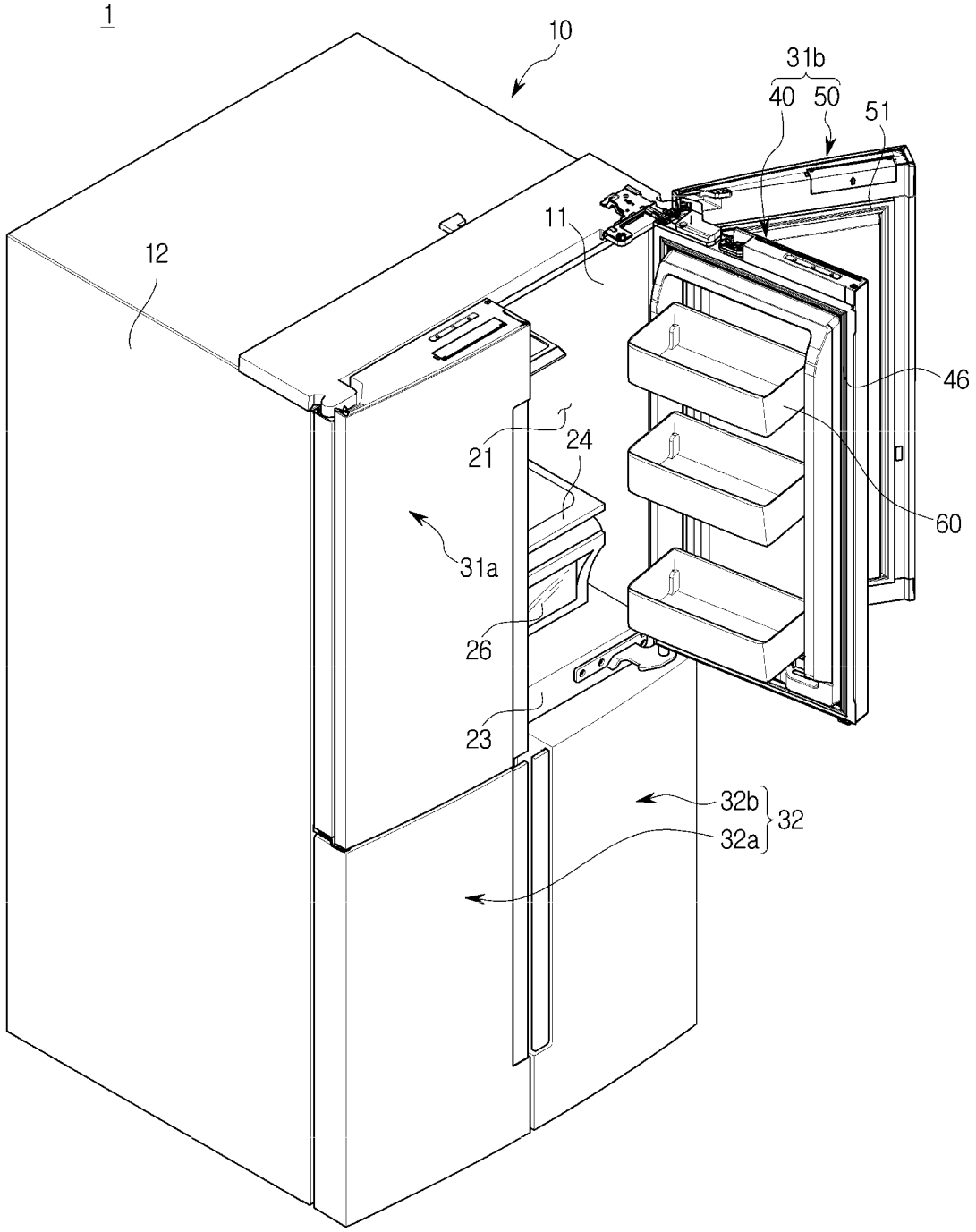
FIG. 2 is a perspective view of the refrigerator according to an embodiment of the present disclosure, showing a state in which some of the doors are opened.

FIG. 1 is a perspective view of a refrigerator according to an embodiment of the present disclosure, showing a state in which doors are closed, and FIG. 2 is a perspective view of the refrigerator according to an embodiment of the present disclosure, showing a state in which some of the doors are opened.

A refrigerator 1 includes a main body 10 forming an outer appearance, a storage compartment partitioned up and down inside the main body 10, doors 30 and 40 to open and close the storage compartment, and a cold air supply (not shown) to supply cold air to the storage compartment.

The cold air supply may include a compressor, a condenser, an expansion valve, an evaporator, a blower fan, a cold air duct, and the like.

A machine chamber (not shown) in which a compressor to compress a refrigerant and a condenser to condense the compressed refrigerant are installed may be provided at a lower portion of the rear of the main body 10.

The main body 10 may include an inner case 11 forming the storage compartment, an outer case 12 coupled to an outer side of the inner case 11 to form the outer appearance, and an insulator (not shown) foamed between the inner case 11 and the outer case 12 to insulate the storage compartment 20.

The cold air supply may generate cold air using a cooling cycle that compresses, condenses, expands and evaporates the refrigerant.

The storage compartment may be partitioned into a first storage chamber 21 and a second storage chamber (not shown) by a horizontal partition wall 23. According to an embodiment of the present disclosure, the first storage chamber 21 may be provided as a refrigerating chamber, and the second storage chamber may be provided as a freezing chamber. However, the positions of the refrigerating chamber and the freezing chamber may be changed.

The first storage chamber 21 may be provided with a shelf 24 on which food may be placed, and a drawer 26 drawn out from the first storage chamber 21 or drawn into the first storage chamber 21 by sliding.

The storage compartment has an open front surface to take food in and out, and the open front surface may be opened and closed by the door 30.

The door 30 may include a first door 31 to open and close the first storage chamber 21 and a second door 32 to open and close the second storage chamber.

The first door 31 and the second door 32 may include left doors 31*a* and 32*a* and right doors 31*b* and 32*b* which are disposed left and right, respectively, to open and close portions of the first storage chamber and the second storage chamber.

The first storage chamber 21 may be opened and closed by the first door 31 rotatably coupled to the main body 10. The second storage chamber may be opened and closed by the second door 32 rotatably coupled to the main body 10.

In the refrigerator 1 according to an embodiment of the present disclosure, the right first door 31*b* to open and close a portion of the first storage chamber 21 may be provided as a double door. Accordingly, the right first door 31*b* may include the inner door 40 and an outer door 50. The left first door 31*a* may be provided as a double door. In addition, the first door 31 may be provided as a general door instead of a double door.

Hereinafter, it will be described that the right first door 31*b* to open and close a portion of the first storage chamber 21 is a double door.

The right first door 31*b* may be provided as a double door. The right first door 31*b* may include the inner door 40 and the outer door 50.

The outer door 50 may be rotatably coupled to the inner door 40. The outer door 50 may be opened or closed independently of the inner door 40 and may be opened or closed together with the inner door 40.

The outer door 50 may be provided with a display 70 to display various states of the refrigerator 1.

The inner door 40 may include an opening 41*b* (see FIG. 3) corresponding to the first storage chamber 21. The opening 41*b* may be opened or closed by the outer door 50. In other words, the outer door 50 may open or close the opening 41*b*.

A door guard 60 in which food may be received may be provided at a rear surface of the inner door 40. The door guard 60 may be detachably coupled to the rear surface of the inner door 40.

A gasket 46 may be provided at an edge of the rear surface of the inner door 40 to seal a gap with the main body 10 in a state where the inner door 40 is closed. The gasket 46 may be installed in a loop shape along the edge of the rear surface of the inner door 40, and a magnet (not shown) may be included therein.

Like the inner door 40, a gasket 51 may be provided at an edge of a rear surface of the outer door 50 to seal a gap with the inner door 40 in a state where the outer door 50 is closed. A magnet (not shown) may be included inside the gasket 46.

Figure 3:
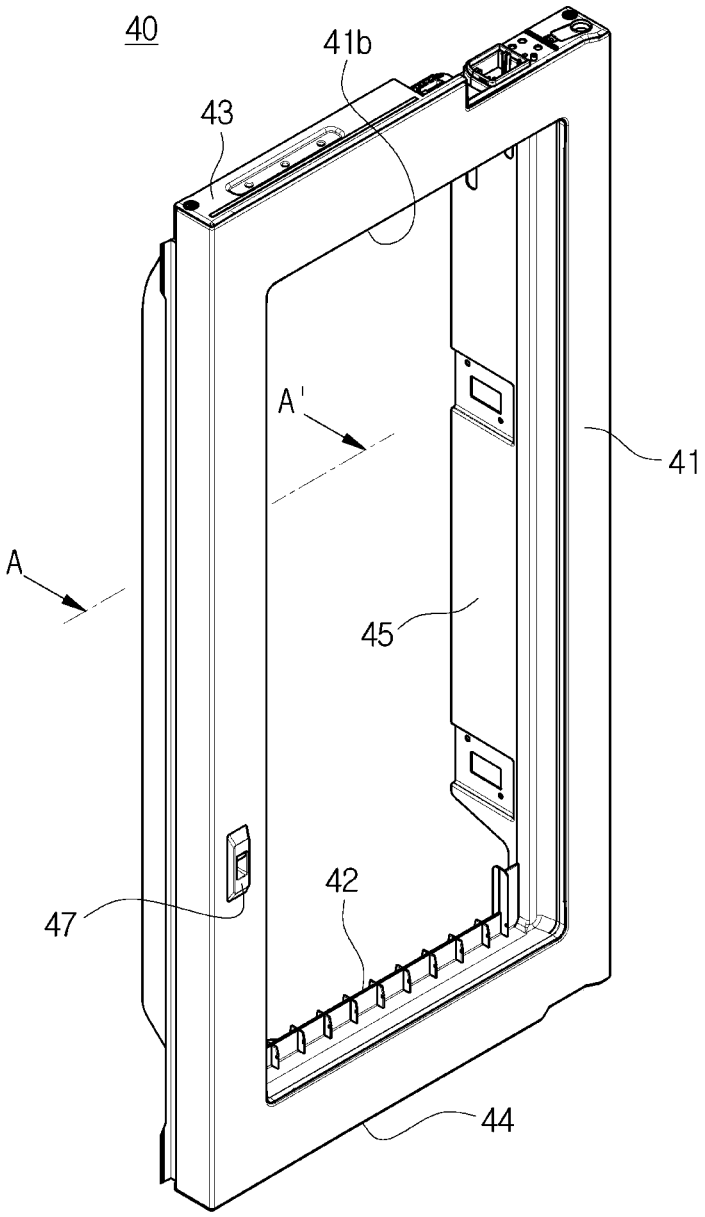
FIG. 3 is a perspective view of an inner door detached from the refrigerator according to an embodiment of the present disclosure.
Figure 4:
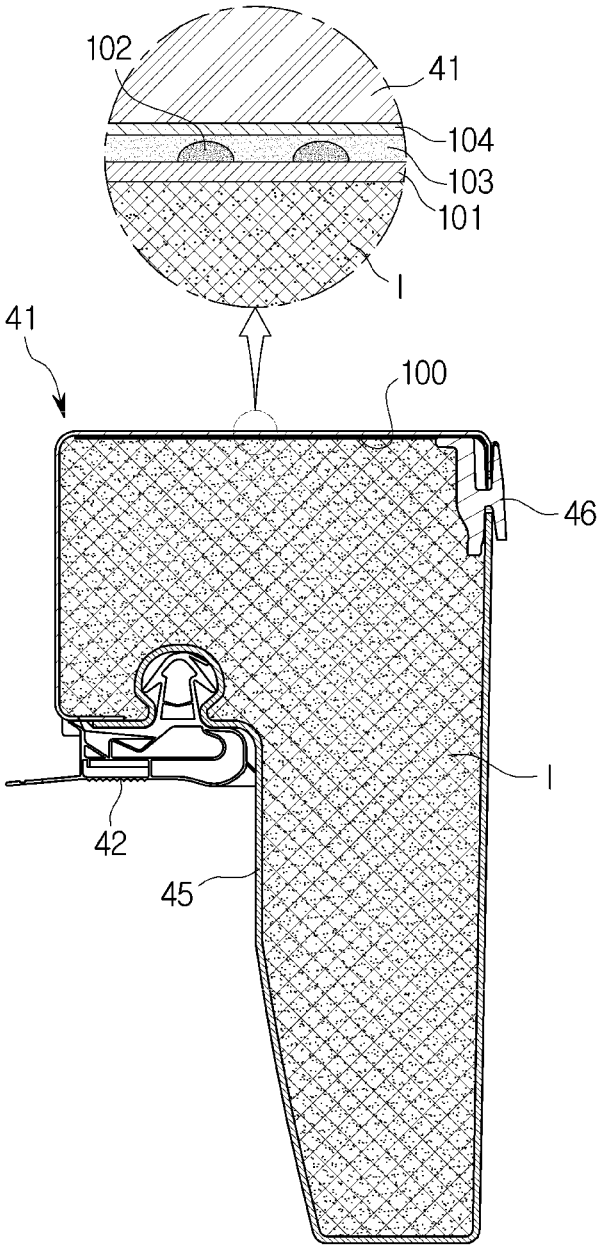
FIG. 4 is a cross-sectional view of the inner door illustrated in FIG. 3.
Figure 5:
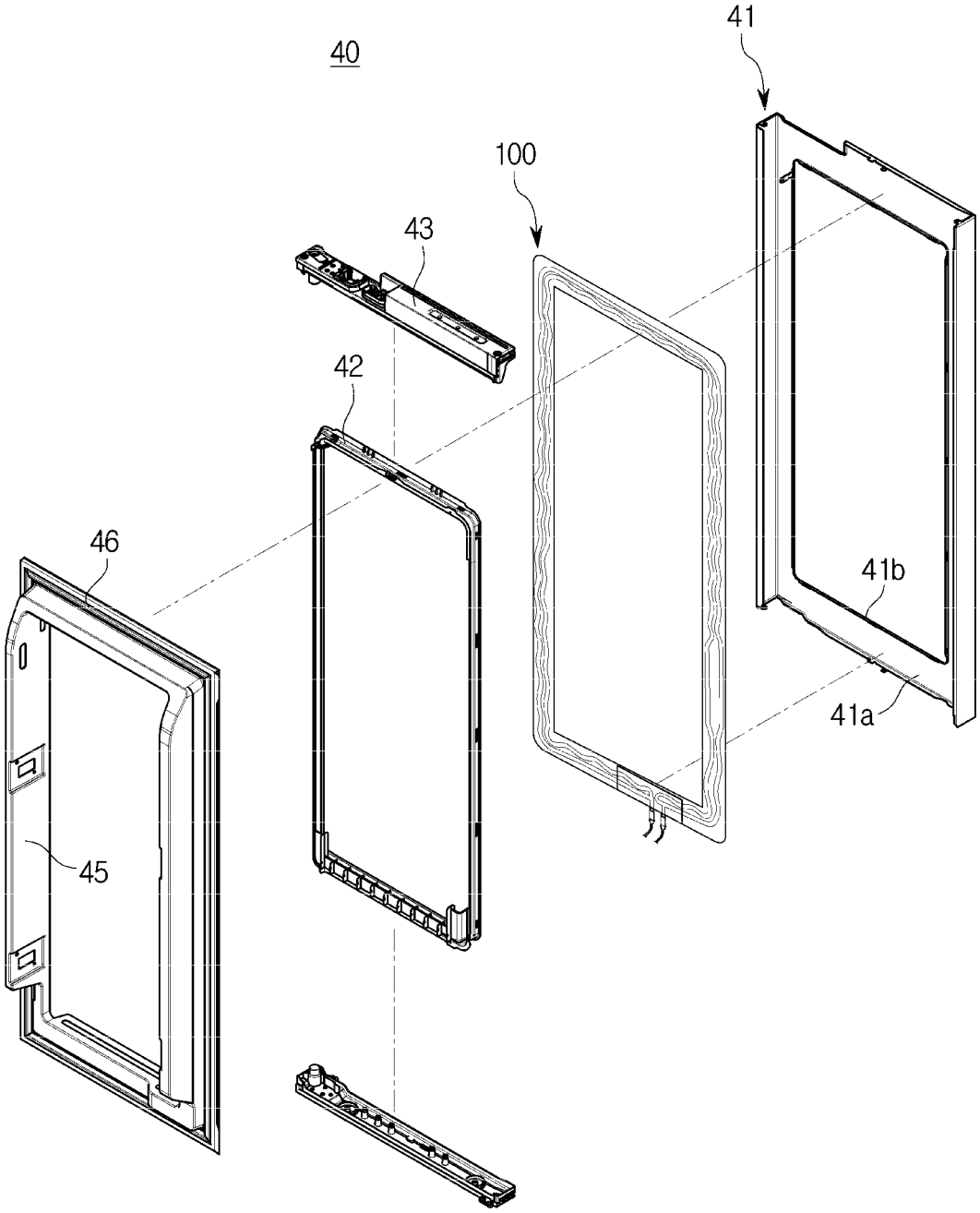
FIG. 5 is an exploded perspective view of the inner door illustrated in FIG. 3.
Figure 6:
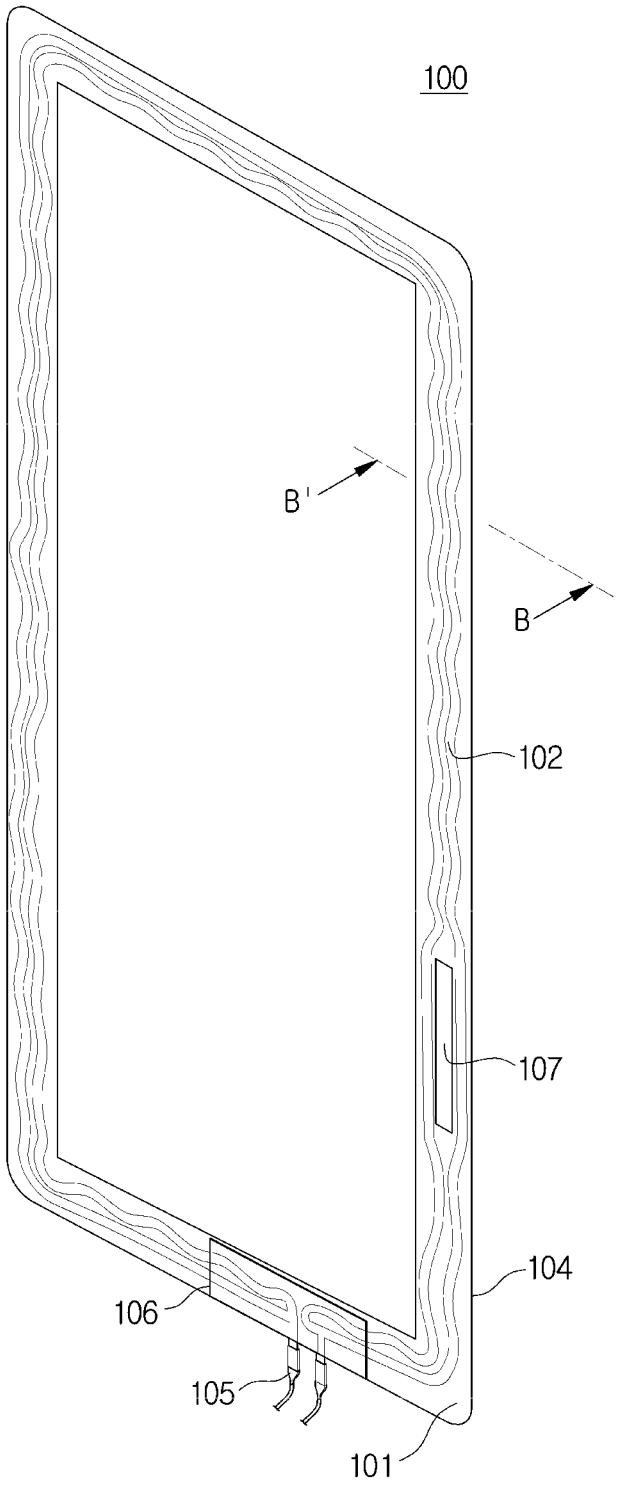
FIG. 6 is an enlarged view of a planar heater illustrated in FIG. 5.

FIG. 3 is a perspective view of an inner door detached from the refrigerator according to an embodiment of the present disclosure, FIG. 4 is a cross-sectional view of the inner door illustrated in FIG. 3, and FIG. 5 is an exploded perspective view of the inner door illustrated in FIG. 3. FIG. 6 is an enlarged view of a planar heater illustrated in FIG. 5.

As illustrated in FIGS. 3 to 6, the inner door 40 includes a door frame 41 having the opening 41*b*, a first planar heater 100 attached to the door frame 41, a guard support 45 coupled to the rear of the door frame 41, an intermediate frame 42 provided between the door frame 41 and the guard support 45, and an upper frame 43 and a lower frame 44 coupled to the intermediate frame 42 at an upper side and a lower side of the intermediate frame 42.

A foam space (not shown) may be formed between the door frame 41 and the guard support 45, and an insulator I may be foamed in the foam space.

One surface of the door frame 41 facing the outer door 50 is referred to as a front surface of the door frame 41. The opposite surface of the front surface is referred to as a rear surface 41*a* of the door frame 40.

When the inner door 40 and the outer door 50 are closed, the door frame 41 maintains a low temperature by cold air supplied into the first storage chamber 21. When the outer door 50 is opened, dew may form on the door frame 41 due to a temperature difference between the door frame 41 and the outside air. Specifically, dew may form on the front surface of the door frame 41.

The first planar heater 100 may be installed on the rear surface 41*a* of the door frame 41 to remove dew condensation. The first planar heater 100 may be connected to a power supply (not shown) provided in the main body 10 to receive current. The first planar heater 100 may be provided to generate heat by receiving the current. When the first planar heater 100 generates heat, a temperature of the door frame 41 increases, thereby reducing a temperature difference with the outside temperature to prevent dew condensation.

The first planar heater 100 may be provided in a film form and may be attached to the rear surface 41*a* of the door frame 41. An adhesive surface having an adhesive force may be provided on one surface of the first planar heater 100. The first planar heater 100 may be attached to the rear surface 41*a* of the door frame 41 without a separate fastener by using the adhesive force of the adhesive surface.

According to an embodiment of the present disclosure, the first planar heater 100 may be installed on the rear surface 41*a* of the door frame 41. In this case, the first planar heater 100 may be attached to the door frame 41 by bringing the adhesive surface of the first planar heater 100 into contact with the rear surface 41*a* of the door frame 41. In addition, as illustrated in FIG. 4, the first planar heater 100 may be provided in the form of a flat film to improve the flowability of a foam liquid foamed in the foam space inside the door as compared to a cord heater. The foam liquid cures to form the insulator I. In this process, because the first planar heater 100 does not interfere with the flow of the foam liquid unlike the cord heater, the flowability of the foam liquid may be improved. In addition, because the first planar heater 100 may prevent the foam liquid from permeating therein, the heating efficiency does not decrease. That is, the quality problem due to dew condensation is not caused. Furthermore, the first planar heater 100 has a larger contact area in contact with the door frame 41 than the cord heater, thereby improving heat transfer efficiency. That is, the heating efficiency may increase.

The first planar heater 100 may be attached to an outer edge of the door frame 41. The first planar heater 100 may be disposed adjacent to the gasket 51 of the outer door provided at the front surface of the door frame 41, and specifically, may be disposed adjacent to an outer edge of the gasket 51. This is because generally dew is formed on the outer edge adjacent to the gasket 51 of the outer door. The first planar heater 100 may be installed on the rear surface of a portion where dew forms on the door frame 41.

As illustrated in FIGS. 4 and 6, the first planar heater 100 may be provided in a film form. The first planar heater 100 may include a base film 101, a surface heating element 102 printed on the base film, and a terminal 105 to supply current to the surface heating element 102 from an external power source (not shown). Terminal 105 may include a reinforcement plate 106 provided for strength reinforcement.

The base film 101 may be provided on one surface of the first planar heater 100, and a double-sided tape 104 may be provided on the other surface of the first planar heater 100. Because the other surface of the first planar heater 100 on which the double-sided tape 104 is provided has an adhesive force due to the double-sided tape 104, hereinafter the other surface of the first planar heater 100 on which the double-sided tape 104 is provided will be referred to as an adhesive surface.

The surface heating element 102 may be printed on one surface of the base film 101 through gravure printing. The surface heating element 102 may include a silver nanoparticle material. The surface heating element 102 may be provided to generate heat when current is supplied.

The planar heater 100 may be provided in various forms according to a form of an object to which the planar heater 100 is attached. For example, the planar heater 100 according to an embodiment of the present disclosure may have an opening 107 formed on a portion where a latch 47 of the inner door 40 is disposed. Through this, the planar heater 100 may be attached to the door frame 41 without interfering with the latch 47.

As illustrated in FIG. 4, the planar heater 100 may include the base film 101, the surface heating element 102 printed on one surface of the base film 101 by gravure printing, a protective film 103 laminated on one surface of the base film 101 to protect the surface heating element 102, and the double-sided tape 104 attached to the protective film 103.

The base film 101 may be formed of polyethylene terephthalate (PET) material. The surface heating element 102 may be provided to generate heat by receiving current. The surface heating element 102 may be a silver nanoparticle ink. The protective film 103 may include polyethylene terephthalate (PET) and ethylene-vinyl acetate copolymer (EVA) materials.

One surface of the double-sided tape 104 may be attached to the protective film 103. Although not shown, the double-sided tape 104 may be attached to the base film 101. Because the double-sided tape 104 is provided on one surface of the planar heater 100, the planar heater 100 may be attached to an object by bring the one surface on which the double-sided tape 104 is provided into contact with the object.

Figure 7:
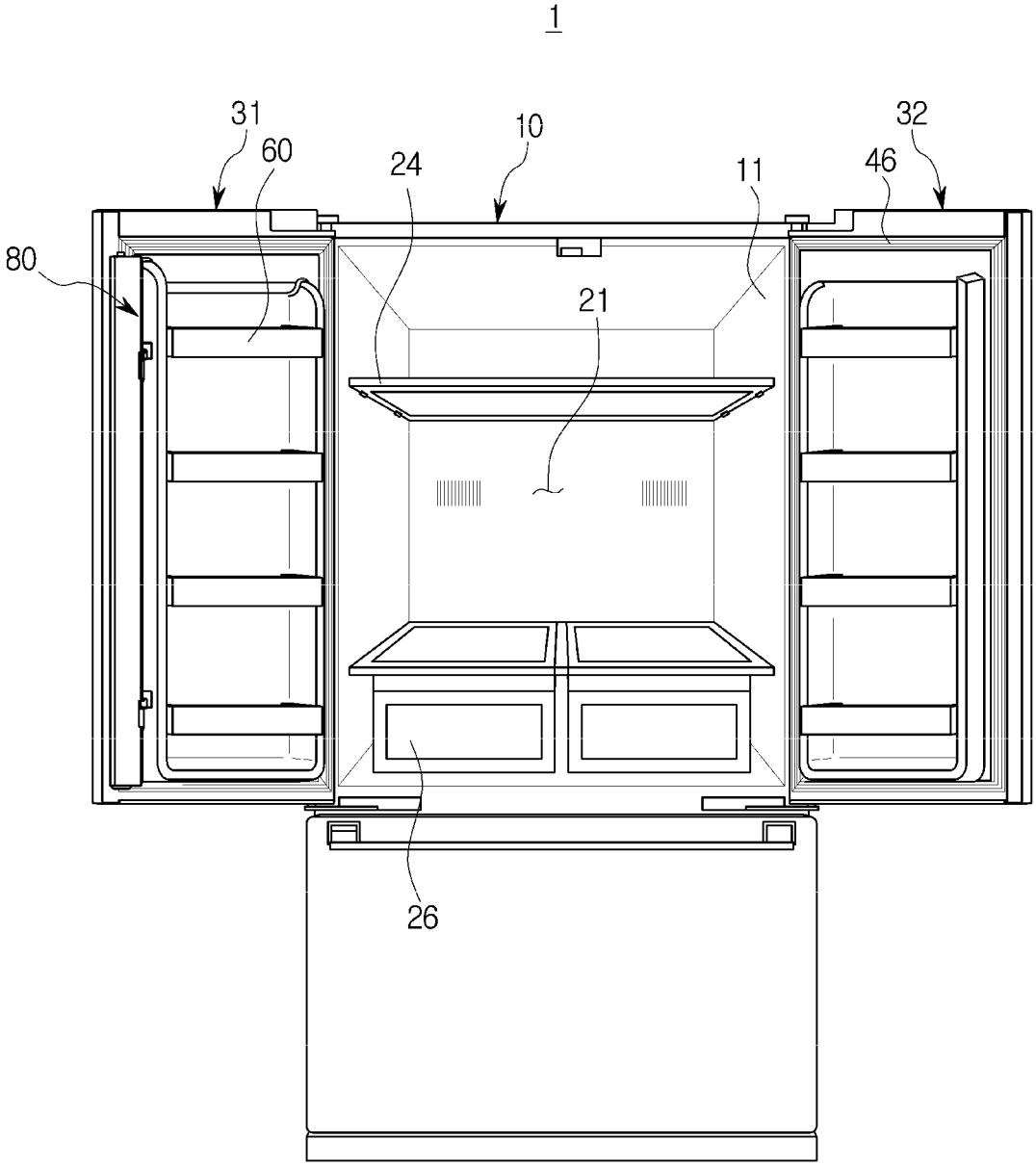
FIG. 7 is a front view of a refrigerator according to another embodiment of the present disclosure.
Figure 8:
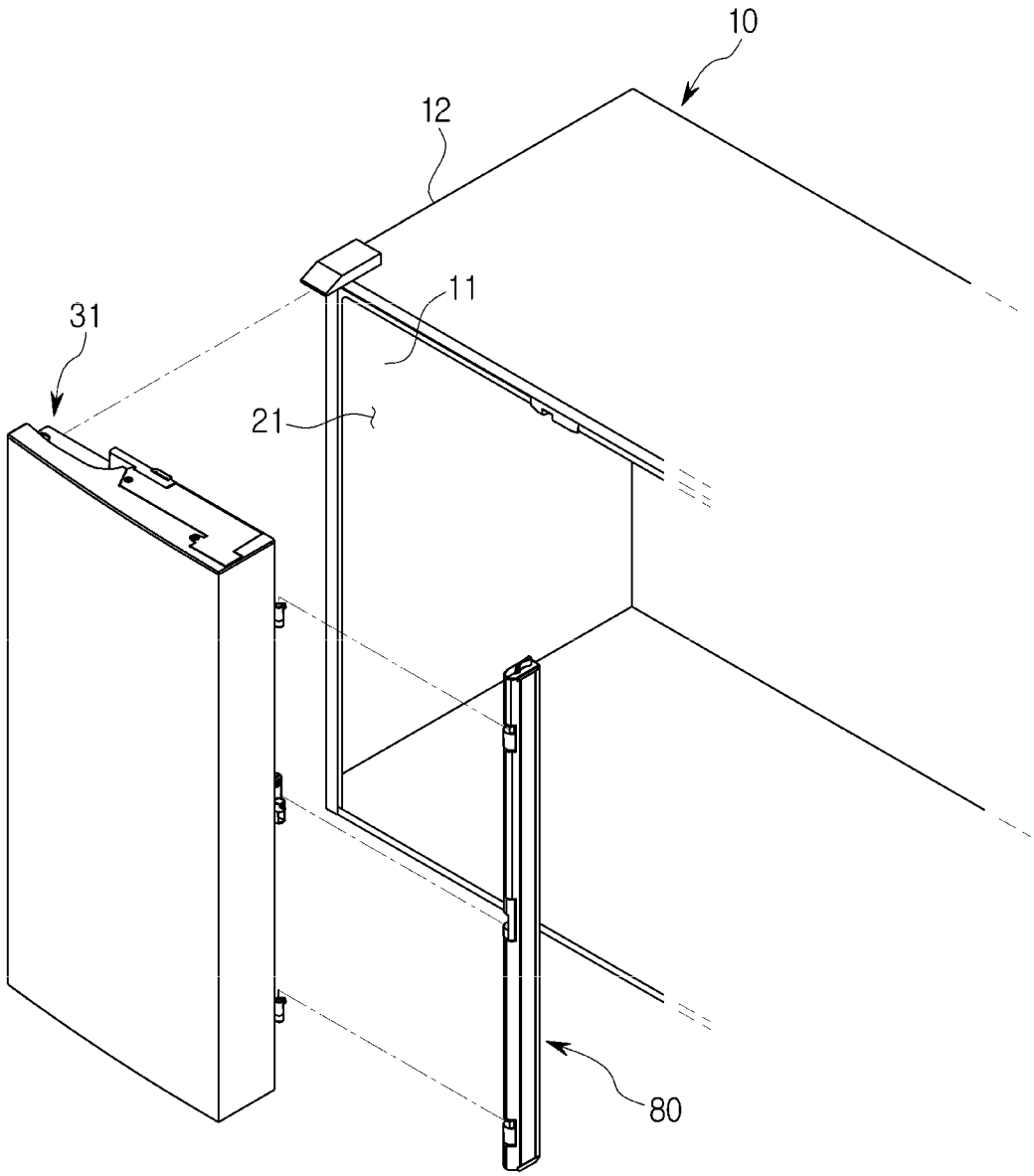
FIG. 8 is an exploded perspective view illustrating a coupling relationship between a door and a rotation bar in the refrigerator of FIG. 7.

FIG. 7 is a front view of a refrigerator according to another embodiment of the present disclosure. FIG. 8 is an exploded perspective view illustrating a coupling relationship between a door and a rotation bar in the refrigerator of FIG. 7, and FIG. 9 is an exploded perspective view illustrating a configuration of a rotation bar of the refrigerator of FIG. 7.

Figure 9:
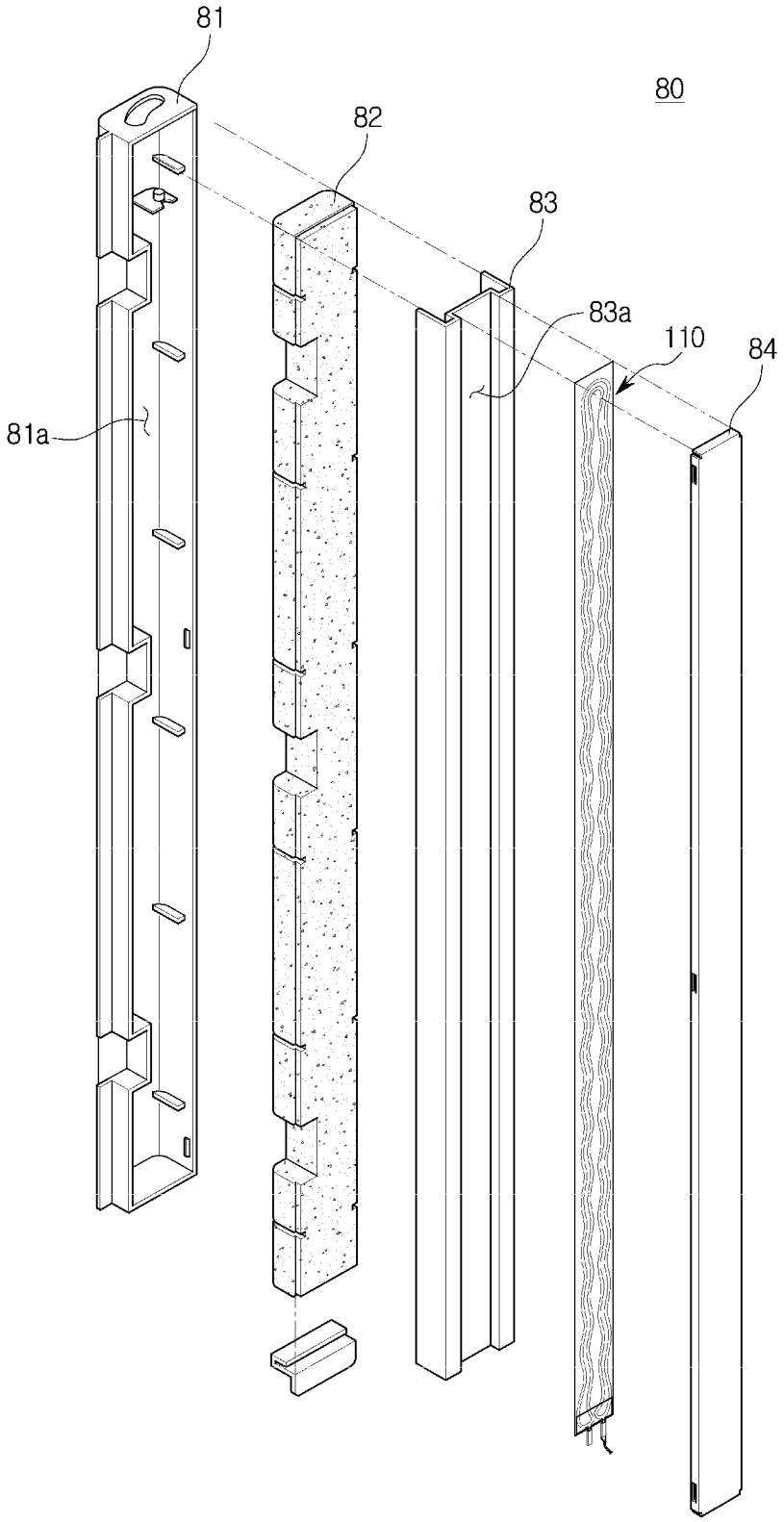
FIG. 9 is an exploded perspective view illustrating a configuration of a rotation bar of the refrigerator of FIG. 7.

Referring to FIGS. 7 to 9, the refrigerator 1 may include a rotation bar 80. FIGS. 7 to 9 are views for explaining the rotation bar 80, and thus the following description is not limited by the type of the refrigerator or the form of the door.

In addition, contents overlapping with those already described with reference to FIGS. 1 to 6 will be omitted.

As illustrated in FIG. 7, while gaps between the first and second doors 31 and 32 and the main body 10 are sealed by the first gasket 36 and the second gasket 46 to prevent leaking of cold air, a gap may also be also formed between the first door 31 and the second door 32 so that cold air leaks. In order to prevent the leakage of cold air in the first storage chamber 21, the rotation bar 80 may be installed on one of the plurality of doors 31 and 32 in the first storage chamber 21 opened and closed by the plurality of doors 31 and 32. The rotation bar 80 may block cold air from leaking between the first door 31 and the second door 32 in a state in which the first door 31 and the second door 32 are closed.

As illustrated in FIG. 8, the rotation bar 80 may be rotatably coupled to one side of the first door 31. The rotation bar 80 may be hinged to one side of the first door 31. The rotation bar 80 may rotate according to opening and closing of the first door 31 to seal a gap between the first door 31 and the second door 32. Alternatively, the rotation bar may be rotatably coupled to one side of the second door.

The rotation bar 80 may be provided to have a bar shape extending along the height direction of the first door 31.

The rotation bar 80 may include a case 81 having an accommodating space 81*a* and an open one side, an insulation member 82 received in the accommodating space 81*a* of the case 81, a cover 83 coupled to the open one side of the case 81, a metal plate 85 coupled to an outer side of the cover 83, and a second planar heater 110 attached to the metal plate to transfer heat to the metal plate.

The case 81 forming an outer appearance of the rotation bar 80 has the open one side and the accommodating space 81*a* therein, and the open one side may be covered by the cover 83.

The insulation member 82 insulating the refrigerating chamber 21 may be formed of an expanded polystyrene (EPS) material having excellent insulation performance and light weight. The insulation member 82 may be substantially formed in a shape capable of being inserted into the accommodating space 81*a* of the case 81, and then may be inserted into the accommodating space 81*a* of the case 81.

However, the insulation member 82 is an optional configuration. This is because a temperature difference between the metal plate 84 and the outside air is reduced due to the second planar heater 110 even if the insulation member 82 is not provided, thereby preventing dew condensation. Accordingly, insulation member 82 may be deleted.

The cover 83 covering the open one side of the case 81 may be coupled to the open one side of the case 81 after the insulation member 82 is inserted into the accommodating space 81*a* of the case 81.

The cover 83 may have a shape bent several times. The cover 83 may form a portion of side surfaces and a portion of a rear surface of the rotation bar 80. The rear surface of the rotation bar 80 refers to a surface directing to the gaskets 36 and 46 of the doors 31 and 32.

The metal plate 84 formed of a metal material may be coupled to the outer side of the cover 83 to provide rigidity to the rotation bar 80.

The second planar heater 110 radiating heat to prevent dew condensation on the metal plate 83 due to a temperature difference between the inside and the outside of the storage chamber 21 may be attached to a rear surface of the metal plate 84 facing the cover 83.

The configuration of the second planar heater 110 is the same as that of the first planar heater 100. The second planar heater 110 may be attached to the cover 83 instead of the metal plate 83. Specifically, the second planar heater 110 may be attached to a central surface 83*a* of the bent and recessed cover 83.

The second planar heater 110 may be disposed at the center of the rotation bar 80 without being biased to either side of the rotation bar 80. The second planar heater 110 may be disposed to be spaced apart from opposite side ends of the rotation bar 80 by a predetermined distance. This is because edges of opposite sides of the rotation bar 80 in contact with the gaskets 36 and 46 have a small temperature difference with the outside so that dew does not form or forms less on the edges and thus the need for a heater is relatively low.

Figure 10:
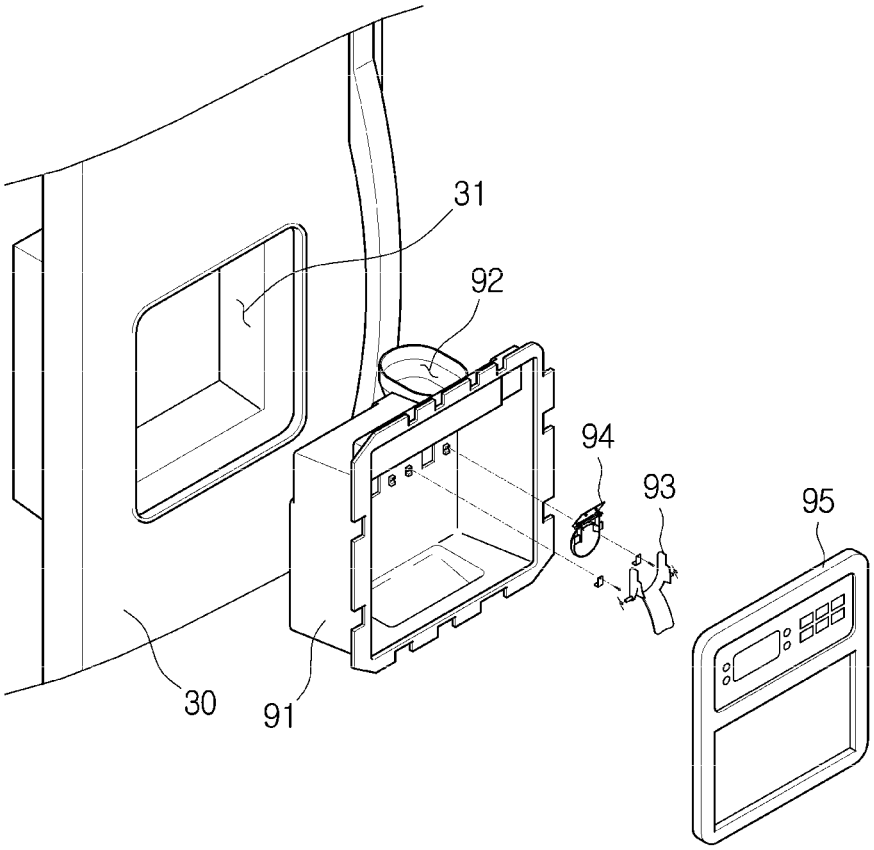
FIG. 10 is an exploded perspective view of a dispenser detached from a refrigerator according to another embodiment of the present disclosure.
Figure 11:
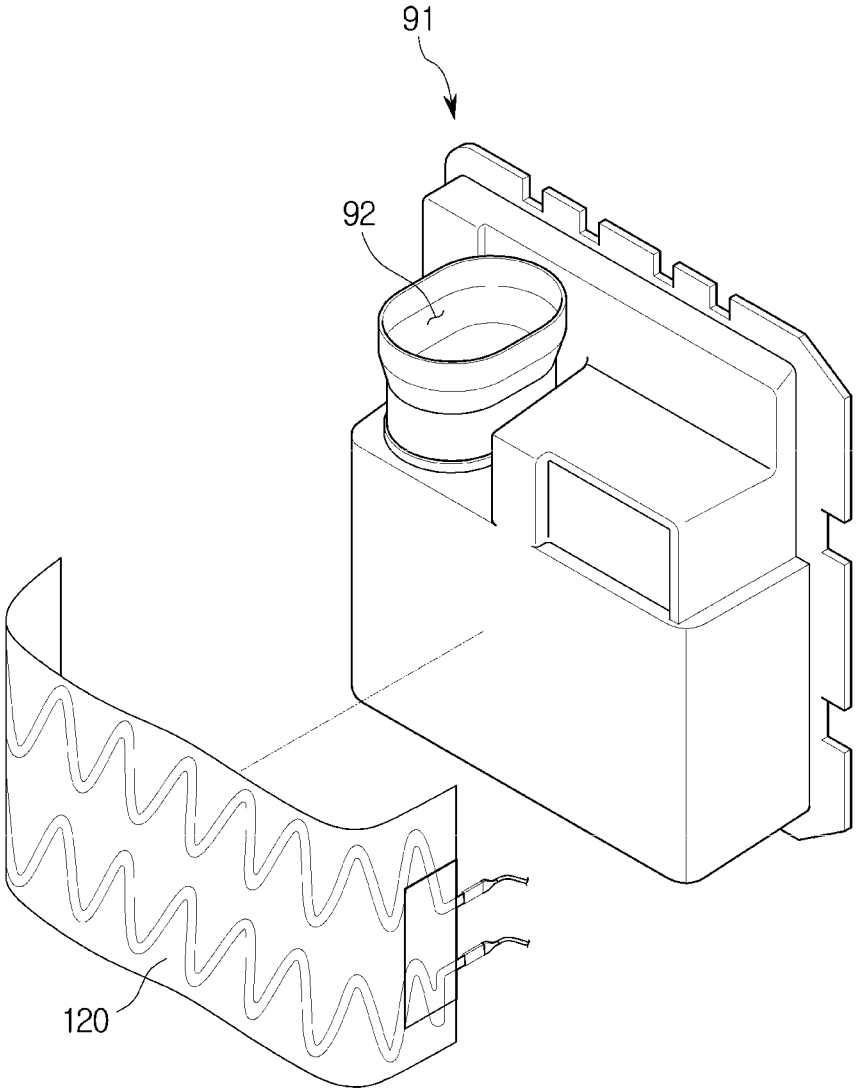
FIG. 11 is a view illustrating a coupling relationship between a casing and a heater of the dispenser illustrated in FIG. 10.

FIG. 10 is an exploded perspective view of a dispenser detached from a refrigerator according to another embodiment of the present disclosure. FIG. 11 is a view illustrating a coupling relationship between a casing and a heater of the dispenser illustrated in FIG. 10.

According to another embodiment of the present disclosure, a refrigerator may include a dispenser capable of providing ice or water to a user.

The dispenser 90 may be installed at an outer side of the door 30 of the refrigerator. The dispenser 90 may be installed in the dispenser accommodating portion 31 formed by recessing the door 30 of the refrigerator. The dispenser 90 may include a dispenser casing 91 including an inlet 92 through which water or ice passes, a water supply lever 93 rotatably coupled to the dispenser casing 91, a valve switch 94 to open and close a valve by rotation of the water supply lever 93, and a dispenser cover 95 coupled to the front of the dispenser casing 91.

Because the dispenser 90 allows ice or cold water to be taken out, the dispenser casing 91 maintains a temperature lower than room temperature. Dew forms on the surface of the dispenser casing 91 due to a temperature difference between the ambient air and the surface of the dispenser casing 91.

In order to prevent such dew condensation, as illustrated in FIG. 11, a third planar heater 120 may be attached to a rear surface of the dispenser casing 91.

The third planar heater 120 has the same configuration as the first planar heater 100 and the second planar heater 110. The third planar heater 120 may be attached to the rear surface of the dispenser casing 91 by an adhesive tape provided on one surface of the third planar heater 120 even if a curved shape is provided on the rear surface of the dispenser casing 91.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator comprising:

a main body having a storage compartment;

a door rotatably coupled to the body to open and close the storage compartment; and a planar heater configured to generate heat by being supplied current and installed on the door to prevent dew condensation from being generated on the door, wherein the planar heater is formed in a film form to be attached to the door, wherein the planar heater comprises:

a base film forming one side of the planar heater;

a double-sided tape forming the other side of the planar heater;

a silver nanoparticle ink printed on an inner surface of the base film;

a protective film arranged between the base film and the double-sided tape to protect the silver nanoparticle ink;

a terminal configured to supply current to the silver nanoparticle ink; and a reinforcement plate arranged on an outer surface of the base film adjacent to the terminal for strength reinforcement.

2. The refrigerator according to claim 1, further comprising a gasket installed in the door to seal a gap between the main body and the door and having a magnet provided therein, wherein the planar heater is provided adjacent to an outer edge of the gasket.

3. The refrigerator according to claim 1, wherein the door is a first door and the refrigerator comprises a second door, and the first door and the second door are rotatably coupled to opposite sides of the main body to open and close the storage compartment.

4. The refrigerator according to claim 3, further comprising a rotation bar rotatably coupled to the first door or the second door to seal a gap between the first door and the second door, wherein the rotation bar comprises a planar heater attached to an inner surface of the rotation bar.

5. The refrigerator according to claim 1, wherein the door comprises a dispenser to provide water, the dispenser comprises a dispenser casing coupled to the door, and the dispenser casing comprises a planar heater attached to an inner surface of the dispenser casing.

6. The refrigerator according to claim 1, wherein the base film comprises a polyethylene terephthalate (PET) material.

7. The refrigerator according to claim 1, wherein the protective film comprises an ethylene-vinyl acetate copolymer (EVA) material.

8. The refrigerator according to claim 1, wherein the silver nanoparticle ink is formed in a curve to transfer heat to a wide region.

* * * * *